US007018178B2

(12) United States Patent
Hunter et al.

(10) Patent No.: US 7,018,178 B2
(45) Date of Patent: Mar. 28, 2006

(54) VARIABLE DISPLACEMENT PUMP AND CONTROL THEREFORE FOR SUPPLYING LUBRICANT TO AN ENGINE

(75) Inventors: Douglas Hunter, Shelby Township, MI (US); Dennis Koenig, Hartland, MI (US)

(73) Assignee: BorgWarner Inc., Auburn Hills, MI (US)

( * ) Notice: Subject to any disclaimer, the term of this patent is extended or adjusted under 35 U.S.C. 154(b) by 239 days.

(21) Appl. No.: 10/406,575

(22) Filed: Apr. 3, 2003

(65) Prior Publication Data

US 2003/0231965 A1 Dec. 18, 2003

Related U.S. Application Data

(60) Provisional application No. 60/369,829, filed on Apr. 3, 2002.

(51) Int. Cl.
*F04B 1/06* (2006.01)

(52) U.S. Cl. ..... 417/219; 417/220; 417/44.2; 417/410.3; 418/31; 418/32; 123/196 R; 123/198 C; 184/6.6

(58) Field of Classification Search ..... 417/219, 417/220, 410.3, 44.2; 418/31, 32; 123/73 AD, 123/198 C, 196; 184/6.5, 6.6
See application file for complete search history.

(56) References Cited

U.S. PATENT DOCUMENTS

| | | | | |
|---|---|---|---|---|
| 2,716,946 | A | 9/1955 | Hardy | |
| 2,799,995 | A * | 7/1957 | Herman | 60/418 |
| 3,011,308 | A | 12/1961 | Wotring | |
| 3,204,859 | A | 9/1965 | Crooks | |
| 3,771,921 | A | 11/1973 | Rohde et al. | |
| 3,918,855 | A | 11/1975 | Bornholdt | |
| 3,973,881 | A | 8/1976 | Melchinger | |
| 4,014,305 | A | 3/1977 | Skinner | |
| 4,035,105 | A | 7/1977 | Dantlgraber | |
| 4,222,718 | A | 9/1980 | Lemke | |
| 4,236,595 | A | 12/1980 | Beck et al. | |
| 4,259,039 | A | 3/1981 | Arnold | |
| 4,292,805 | A | 10/1981 | Acheson | |
| 4,325,215 | A | 4/1982 | Yamamoto | |
| 4,328,480 | A | 5/1982 | Keitel et al. | |
| 4,348,159 | A | 9/1982 | Acheson | |
| 4,369,743 | A | 1/1983 | Holt et al. | |
| 4,450,818 | A | 5/1984 | Thoma et al. | |
| 4,468,173 | A | 8/1984 | Dantlgraber | |
| 4,496,288 | A | 1/1985 | Nakamura et al. | |
| 4,510,962 | A | 4/1985 | Mott et al. | |
| 4,531,706 | A | 7/1985 | Weiger et al. | |
| 4,531,898 | A | 7/1985 | Ideta | |
| 4,538,974 | A | 9/1985 | Stich et al. | |
| 4,606,313 | A * | 8/1986 | Izumi et al. | 123/386 |
| 4,632,638 | A | 12/1986 | Shibayama et al. | |
| 4,693,081 | A | 9/1987 | Nakamura et al. | |
| 4,710,106 | A * | 12/1987 | Iwata et al. | 417/213 |

(Continued)

FOREIGN PATENT DOCUMENTS

| | | |
|---|---|---|
| CA | 23 85 897 | 11/2003 |

(Continued)

*Primary Examiner*—Charles G. Freay
*Assistant Examiner*—Emmanuel Sayoc
(74) *Attorney, Agent, or Firm*—Warn, Hoffmann, Miller & LaLone, P.C.; Greg Dziegielewski

(57) ABSTRACT

A control system for a variable displacement pump. The control system is operably associated with an engine control unit for passively or actively controlling the output of the pump in response to signals from the engine control unit.

39 Claims, 9 Drawing Sheets

U.S. PATENT DOCUMENTS 4,711,616 A * 12/1987 Tsukahara et al. ..... 417/216
4,738,330 A 4/1988 Suzuki et al.
4,740,142 A 4/1988 Rohs et al.
4,754,738 A 7/1988 Grohn et al.
4,774,918 A 10/1988 Kurio et al.
4,803,969 A 2/1989 Hiereth et al.
4,825,692 A 5/1989 Rohs et al.
4,850,269 A 7/1989 Hancock et al.
4,905,807 A 3/1990 Rohs et al.
4,974,562 A 12/1990 Ishii et al.
4,976,230 A 12/1990 Voigt
5,017,098 A 5/1991 Hansen et al.
5,052,896 A 10/1991 Fischer et al.
5,063,895 A 11/1991 Ampferer
5,067,454 A 11/1991 Waddington et al.
5,078,233 A 1/1992 Oetting et al.
5,085,187 A 2/1992 Black
5,090,881 A 2/1992 Suzuki et al.
5,101,789 A 4/1992 Voigt et al.
5,105,679 A 4/1992 Voigt
5,141,418 A 8/1992 Ohtaki et al.
5,190,003 A 3/1993 Voigt
5,195,474 A 3/1993 Urata et al.
5,197,860 A * 3/1993 Nishida et al. ..... 417/34
5,239,885 A 8/1993 Voigt
5,273,020 A 12/1993 Hayami
5,303,551 A * 4/1994 Lee ..... 60/431
5,315,971 A 5/1994 Yamada
5,339,776 A 8/1994 Regueiro
5,353,753 A 10/1994 McGrath et al.
5,355,851 A 10/1994 Kamiya
5,390,635 A 2/1995 Kidera et al.
5,398,505 A 3/1995 Oogushi et al.
5,404,855 A 4/1995 Yen et al.
5,435,698 A 7/1995 Phillips
5,465,699 A 11/1995 Voigt
5,467,843 A 11/1995 Esch et al.
5,484,271 A 1/1996 Stich
5,485,725 A 1/1996 Teraoka
5,490,770 A 2/1996 Oogushi
5,527,156 A * 6/1996 Song ..... 417/2
5,544,628 A 8/1996 Voigt
5,545,014 A 8/1996 Sundberg et al.
5,545,018 A 8/1996 Sundberg
5,588,504 A 12/1996 Spiegel et al.
5,618,165 A 4/1997 Larsson et al.
5,630,383 A 5/1997 Kidera et al.
5,690,479 A 11/1997 Lehmann et al.
5,752,815 A 5/1998 Muller
5,797,732 A 8/1998 Watanabe et al.
5,800,131 A 9/1998 Lehmann et al.
5,826,556 A 10/1998 Ruman et al.
5,863,189 A 1/1999 Sundberg et al.
5,904,126 A 5/1999 McKay et al.
5,918,573 A 7/1999 Killion
5,921,758 A 7/1999 Anamoto et al.
5,947,695 A * 9/1999 Nagaoka et al. ..... 417/213
5,996,541 A 12/1999 Voigt et al.
6,053,137 A 4/2000 Trzmiel et al.
6,065,433 A 5/2000 Hill
6,079,380 A 6/2000 Jorgensen et al.
6,131,539 A 10/2000 Thomas
6,155,797 A 12/2000 Kazuyoshi
6,183,210 B1 * 2/2001 Nakamura ..... 417/222.1
6,202,016 B1 3/2001 Stephenson et al.
6,216,651 B1 4/2001 Ishikawa et al.
6,408,975 B1 6/2002 Bishop et al.
6,413,054 B1 * 7/2002 Geiger et al. ..... 417/219
6,488,479 B1 12/2002 Berger
6,524,076 B1 2/2003 Konishi
6,530,752 B1 * 3/2003 Oba et al. ..... 417/220
6,615,683 B1 9/2003 Voigt
6,669,439 B1 12/2003 Kardasz et al.
6,790,013 B1 * 9/2004 Hunter et al. ..... 417/220
6,896,489 B1 * 5/2005 Hunter et al. ..... 417/220
2001/0036412 A1 * 11/2001 Konishi ..... 417/220
2005/0118033 A1 * 6/2005 Schneider ..... 417/213

FOREIGN PATENT DOCUMENTS

DE 32 304 32 2/1984
DE 32 386 50 4/1984
DE 34 46 603 A 1 7/1985
DE 34 466 03 7/1985
DE 36 217 20 1/1987
DE 37 11792 10/1987
DE 37 295 45 3/1988
DE 37 423 15 7/1988
DE 38 243 98 2/1989
DE 38 40 909 6/1989
DE 39 25 249 3/1990
DE 43 02 610 1/1993
DE 42 42 871 6/1994
DE 43 02 610 A 1 8/1994
DE 44 44 819 6/1996
DE 101 41 786 3/2003
DE 101 44 693 3/2003
DE 40 38 549 7/2003
DE 102 37 801 7/2003
EP 1 076 164 2/2001
EP 1 130 262 9/2001
EP 1 316 683 6/2003
EP 1 350 930 10/2003
FR 2 597 546 10/1987
FR 2 673 676 9/1992
JP 62 294 790 12/1987
JP 8 14164 1/1996
JP 2001 159395 6/2001
JP 2001 173575 6/2001
JP 2001159395 6/2001
JP 02001173575 A 6/2001
JP 2001-294166 10/2001
JP 2001294166 10/2001
WO WO 01/55597 8/2001
WO WO 01/79703 10/2001
WO 4038 549 7/2003
WO WO 03/058071 7/2003

* cited by examiner

VARIABLE DISPLACEMENT PUMP AND CONTROL THEREFORE FOR SUPPLYING LUBRICANT TO AN ENGINE

CROSS-REFERENCE TO RELATED APPLICATIONS

This application is a non-provisional application basing priority on U.S. Provisional Application No. 60/369,829, filed Apr. 3, 2002.

FIELD OF THE INVENTION

The present invention relates to the control of the output of a variable displacement pump. More specifically, the present invention relates to control of an oil pump for oil pressure control in an internal combustion engine, transmission or the like.

BACKGROUND OF THE INVENTION

It is desirable to properly lubricate the moving components in an internal combustion engine and provide hydraulic power. Typically, oil pumps used in engines are directly connected to the crankshaft of the engine. While this configuration is generally adequate, there are some disadvantages. First, there is not much control of the actual discharge pressure relative to the pressure needed by the engine under certain/given operating conditions. For instance, during start-up conditions it may be desirable to have higher initial pressure to get engine oil into the engine. At crucial start-up, this cannot be facilitated with the direct drive pumps. Additionally, with the pump shaft RPM directly tied to the engine RPM, in many areas over the RPM range the engine oil pressure is higher or lower than that which is desirable. This results in inefficient use of engine power and/or inefficient engine oil lubrication.

In commonly assigned co-pending application U.S. Ser. No. 10/021,566, a mechanical hydraulic arrangement is shown for providing control of a variable displacement vane pump. This provides for a more optimized control of engine oil pressure. However, it is yet desirable to provide some further control depending on engine needs or variables. Thus, in the present invention there is provided a method of control and system for control of a variable displacement vane pump by the use of an engine control unit which actuates a solenoid for directly or indirectly controlling the stroke of a variable displacement vane pump.

SUMMARY OF THE INVENTION

A control system for a hydraulic variable displacement vane-type pump wherein input from an engine control unit actuates a solenoid for controlling the engine oil pressure to the desired level under any operating conditions.

A further understanding of the present invention will be had in view of the description of the drawings and detailed description of the invention, when viewed in conjunction with the subjoined claims.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

In the present invention, a method of controlling a variable displacement pump 10 for an engine is provided. In a preferred embodiment of the invention that incorporates a solenoid 26, unless stated otherwise, it should be understood that the solenoid 26 is normally, or is defaulted to, the closed position when no power is supplied to the solenoid 26. When the solenoid 26 is in the closed position there will be high fluid displacement by the pump 10. Thus, in an emergency event, such as when there is an electrical failure, the solenoid 26 will move to its default position so the engine oil pressure will remain high and that the vehicle can continue operating until it can serviced. However, it is to be understood that with the solenoid in a closed position the system could also be configured so that there is fluid displacement with the pump 10.

Figure 1:
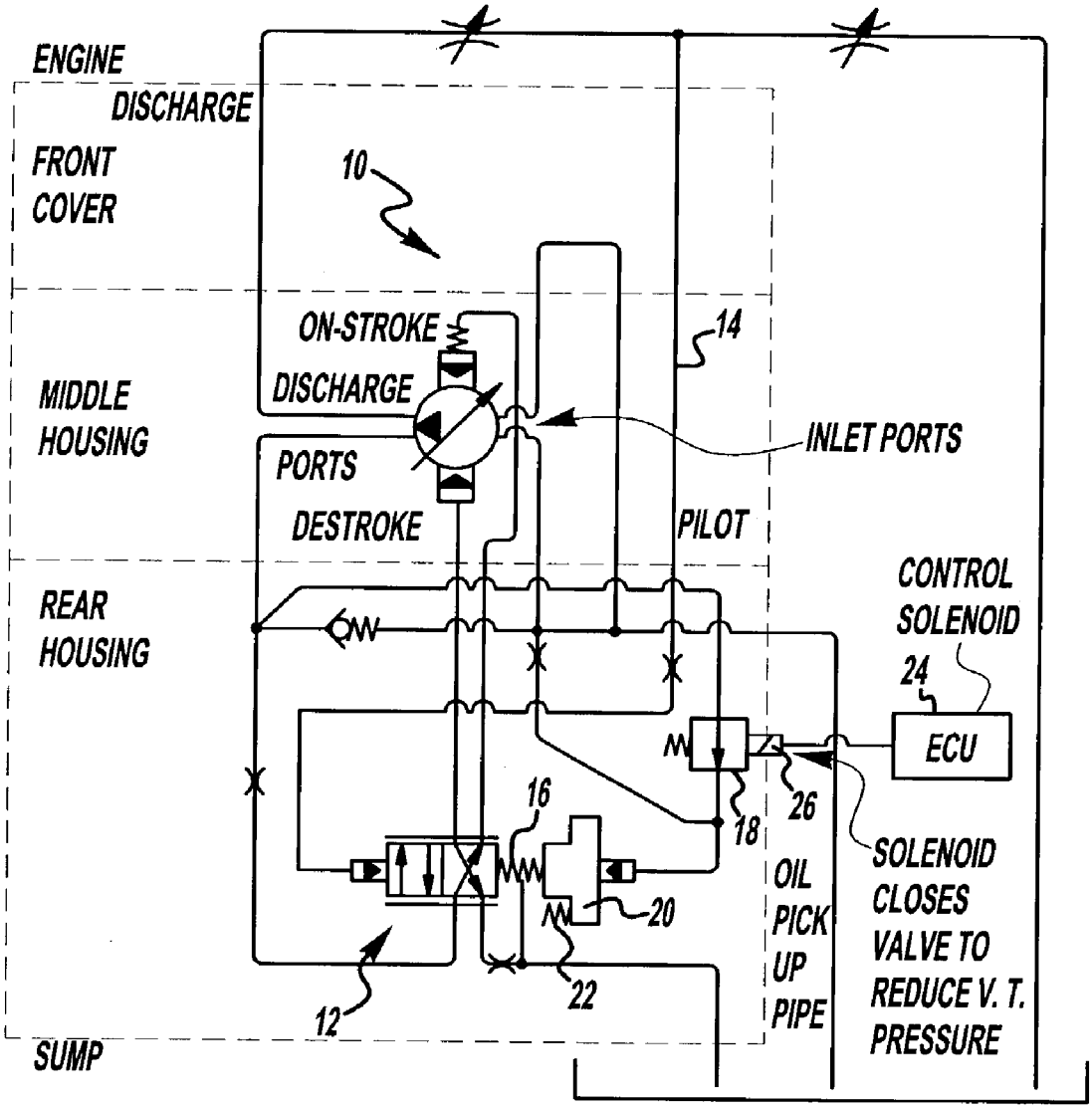
FIG. 1 is a hydraulic schematic showing a first embodiment of the present invention.

In accordance with FIG. 1, the pump is a vane-type variable displacement pump, as set forth in co-pending application Ser. No. 10/021,566, filed Dec. 12, 2000, the specification of which is incorporated by reference herein. Specifically, the pump is designed for an engine lubrication circuit. The pump is generally shown at 10. The pump 10 may be a vane pump which has the displacement varied by movement of an eccentric ring 11. It is also possible to incorporate other types of pumps, in which the stroke or displacement may be adjusted during operation.

A flow control valve 12 is used to mechanically vary the displacement of a pump 10, by moving the eccentric ring 11, based on an engine pilot pressure 14 acting on the flow control valve 12 which controls the volume of oil in each control chamber on each side of the eccentric ring 11. A compression spring 16 acts against a pilot pressure 14 for maintaining some pressure on the flow control valve 12 and to provide a return pressure in absence of the pilot pressure 14. The flow control valve 12 in this particular embodiment is a spool valve such as a three-way spool valve. However, it should be understood that the flow control valve 12 can be a spool valve of any type of configuration. Also, the flow control valve 12 does not necessarily need to be a spool valve at all, as will be seen in FIG. 6. The compression spring 16 gives the spool portion of the valve 12 travel distance that is proportional to the differential between the actual pressure of the system and the desired or target system pressure. The differential pressure is variable by way of a valve 18, which controls the amount of pressure acting on the variable target piston 20 against spring 22 for varying the amount of spring 16 pressure on valve 12. An engine control unit (ECU) 24 monitors the engine conditions and parameters such as temperature, speed and engine load. In this embodiment, the engine control unit 24 monitors the engine conditions and parameters such as temperature, speed, and engine load and then selects a desired oil pressure, and sends the appropriate current to the solenoid 26 acting on valve 18. This varies the pressure acting on the piston 20, changing its position and thereby reducing or increasing target pressure, depending upon the desired engine oil pressure target. The flow control valve 12 then regulates the pump's 10 eccentric ring 11 to maintain target pressure.

Figure 2:
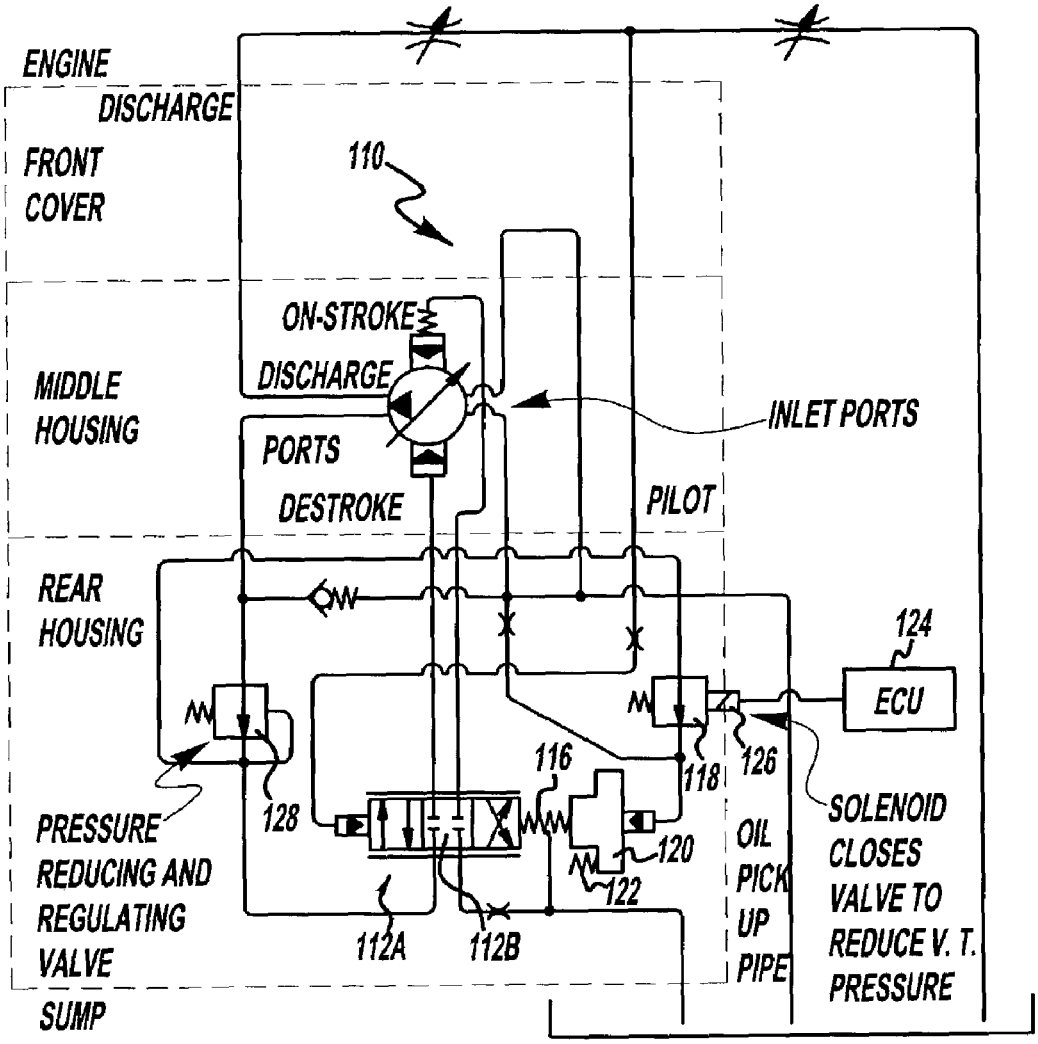
FIG. 2 is a hydraulic schematic showing a second embodiment of the present invention

With respect to FIG. 2, like items referenced in FIG. 1 are similarly designated with reference numerals differing by 100. The operation of this embodiment is similar to the embodiment shown in FIG. 1. The valve 112*a* includes a closed center valve portion 112*b*. However, the main operating difference is the use of a pressure reducing and regulating valve 128. The regulating valve 128 creates a fixed input pressure for the solenoid valve 118 in that the pressure, which in FIG. 1 was taken from the discharge port of the pump 10 into the solenoid control valve 18, is now at a constant pressure and, therefore, provides better control of the variable target pressure acting on piston 120. This ultimately provides improved control over the desired movement of the eccentric ring 111 of the pump 110.

Figure 2A:
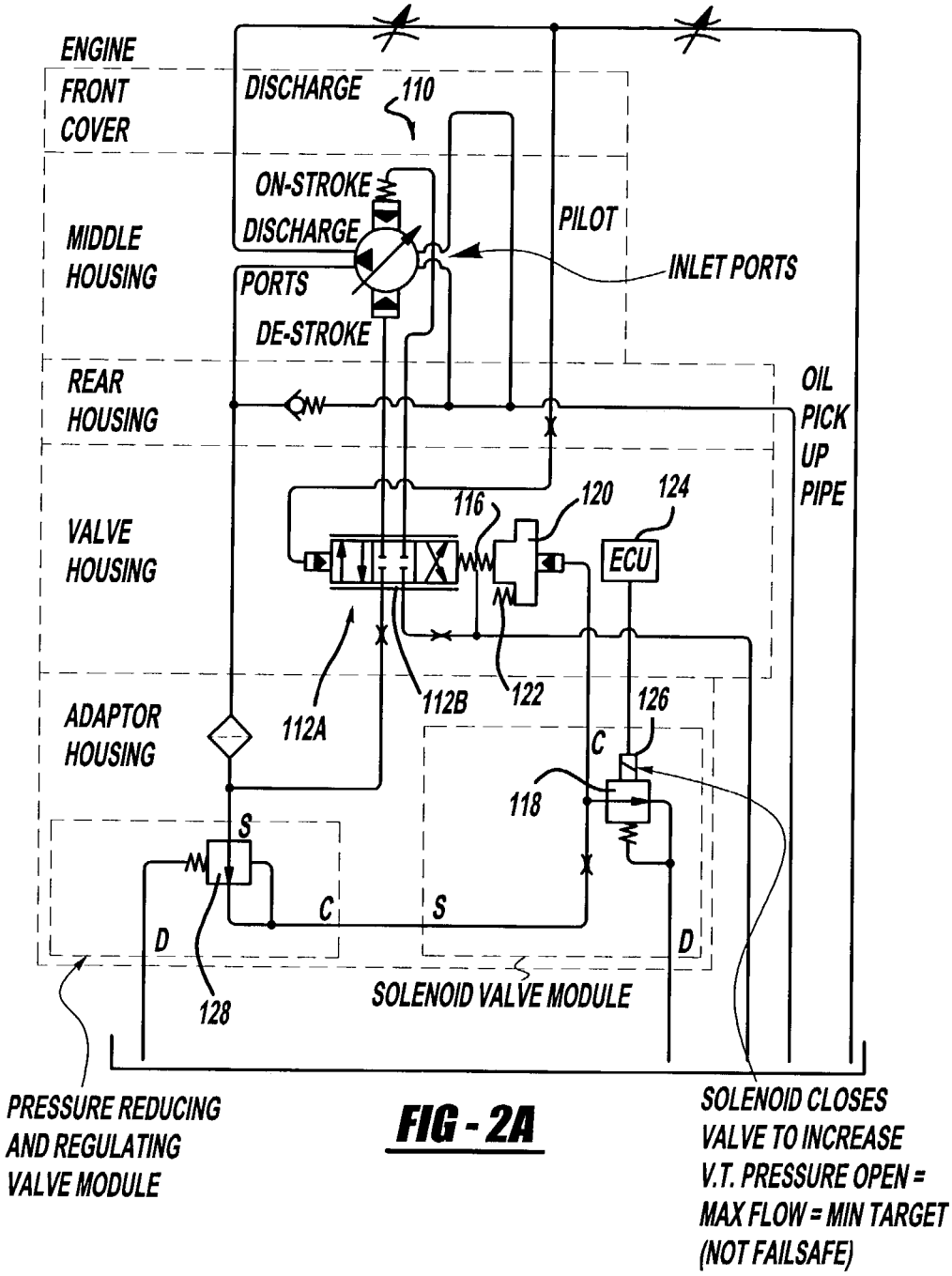
FIG. 2*a* is a variation of the second embodiment of the present invention.

FIG. 2*a* operates in a similar manner as FIG. 2. The main difference between FIG. 2 and FIG. 2*a* is that the pressure reducing and regulating valve 128 of FIG. 2*a* creates a fixed target pressure that acts directly on the piston 120. The solenoid 126 opens or closes to further adjust the pressure of fluid acting on the piston 120. When the solenoid 126 moves the valve 118*a* to the closed position there is an increase in variable target pressure. When the solenoid 126 moves the valve 118*a* to the open position the variable target pressure will decrease as the fluid moves to the sump with less resistance. Additionally, unreduced pressure is fed to the spool valve 112A before pressure the pressure reducing and regulating valve 128 after the filter. Just as in FIG. 2, this embodiment is also a passive system for controlling oil flow and oil pressure since an engine control unit 124 controls the solenoid 126 for positioning the piston 120, however, the engine control unit 124 does not directly sense oil pressure.

Figure 3:
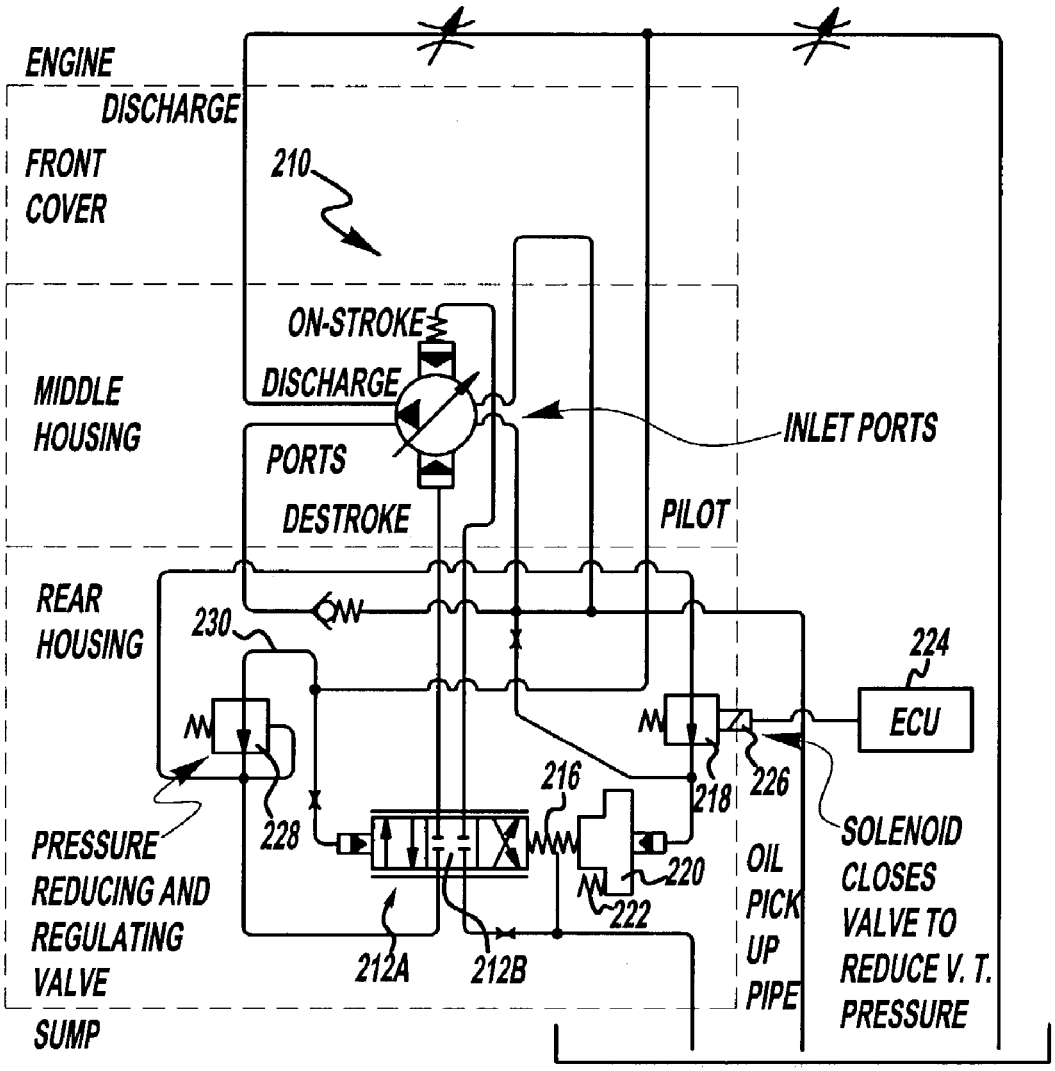
FIG. 3 is a hydraulic schematic showing a third embodiment of the present invention.

With respect to FIG. 3, like items referenced in FIG. 2 are similarly designated with reference numerals differing by 100. In FIG. 3, the source for the pressure which is regulated by the valve 218 is taken from the pilot line instead of the discharge line. Otherwise, the control operation is similar to that shown in FIGS. 1 and 2.

Figure 4:
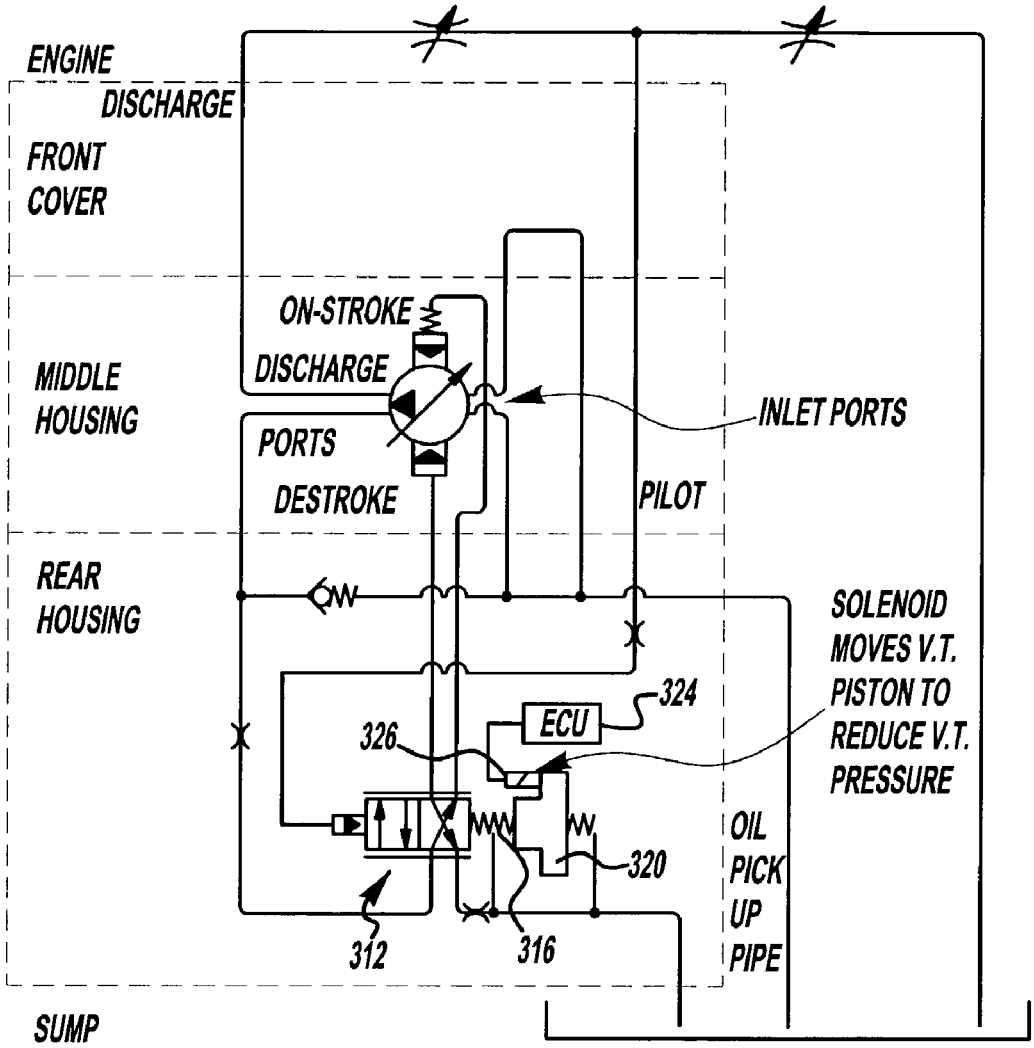
FIG. 4 is a hydraulic schematic showing a forth embodiment of the present invention.

With respect to FIG. 4, like items referenced in FIG. 3 are similarly designated with reference numerals differing by 100. In this particular embodiment the solenoid 326 directly controls the movement of the variable target piston 320. The engine control unit 324 is connected to the solenoid 326 and controls the actuation of the solenoid. The configuration of this embodiment (i.e., the solenoid acting directly on the variable target piston 320) allows the variable target piston to be adjusted in accordance with the engine control unit's 324 commands directly, rather than using additional hydraulics.

Figure 5:
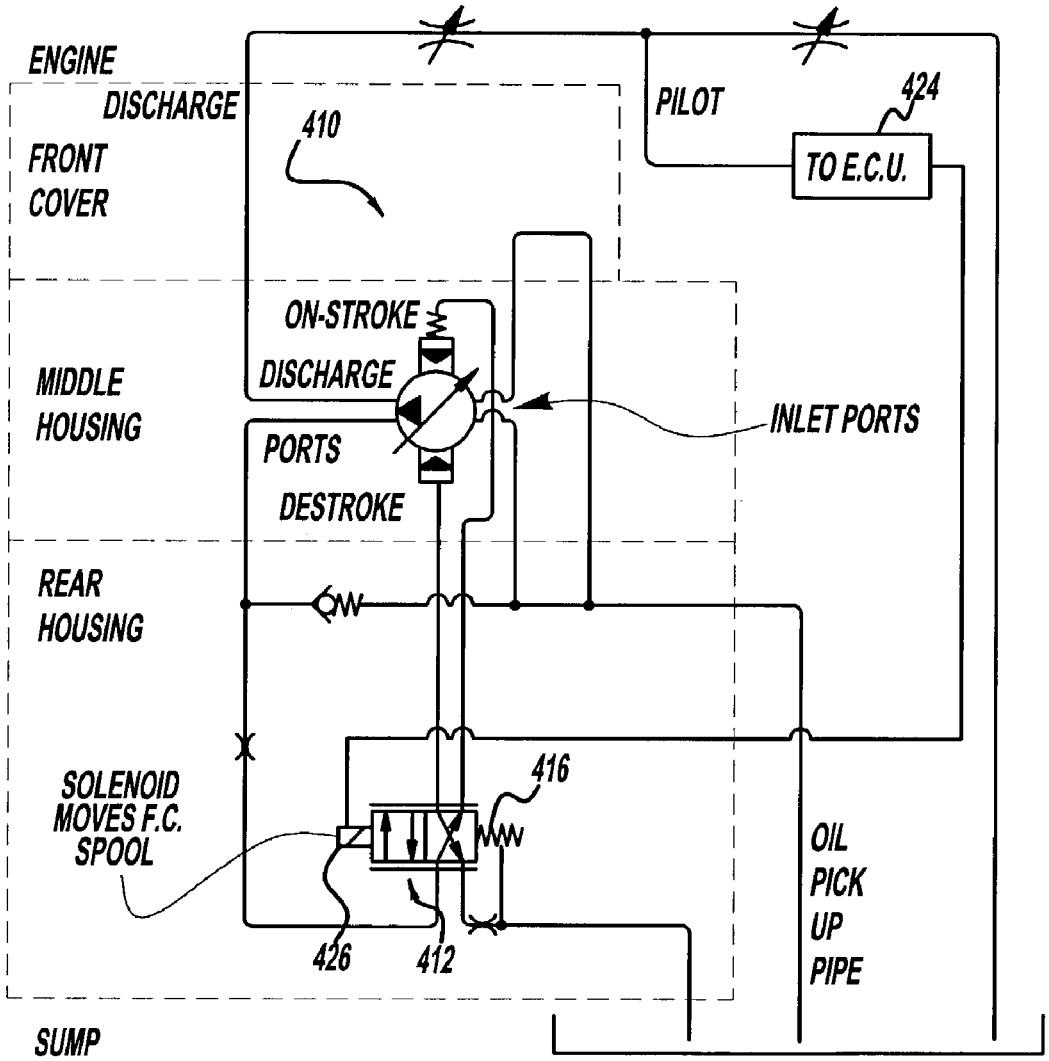
FIG. 5 is a hydraulic schematic showing a fifth embodiment of the present invention.

With respect to FIG. 5, like items referenced in FIG. 4 are similarly designated with reference numerals differing by 100. With respect to FIG. 5, this embodiment includes a solenoid 426 attached to the flow control spool valve 412 directly, to regulate the stroke or de-stroke conditions of the pump 410. The solenoid 426 is connected directly to the engine control unit 424. The engine control unit 424 samples the pilot pressure from a pressure transducer in the engine circuit in order to make the proper calculations as to the best spool position based on the current actual and target pressures. Return spring 416 provides the return pressure for adjusting the flow control spool valve 412 in absence of solenoid 426 input, and allows for predetermined functions of spool position versus current.

Figure 6:
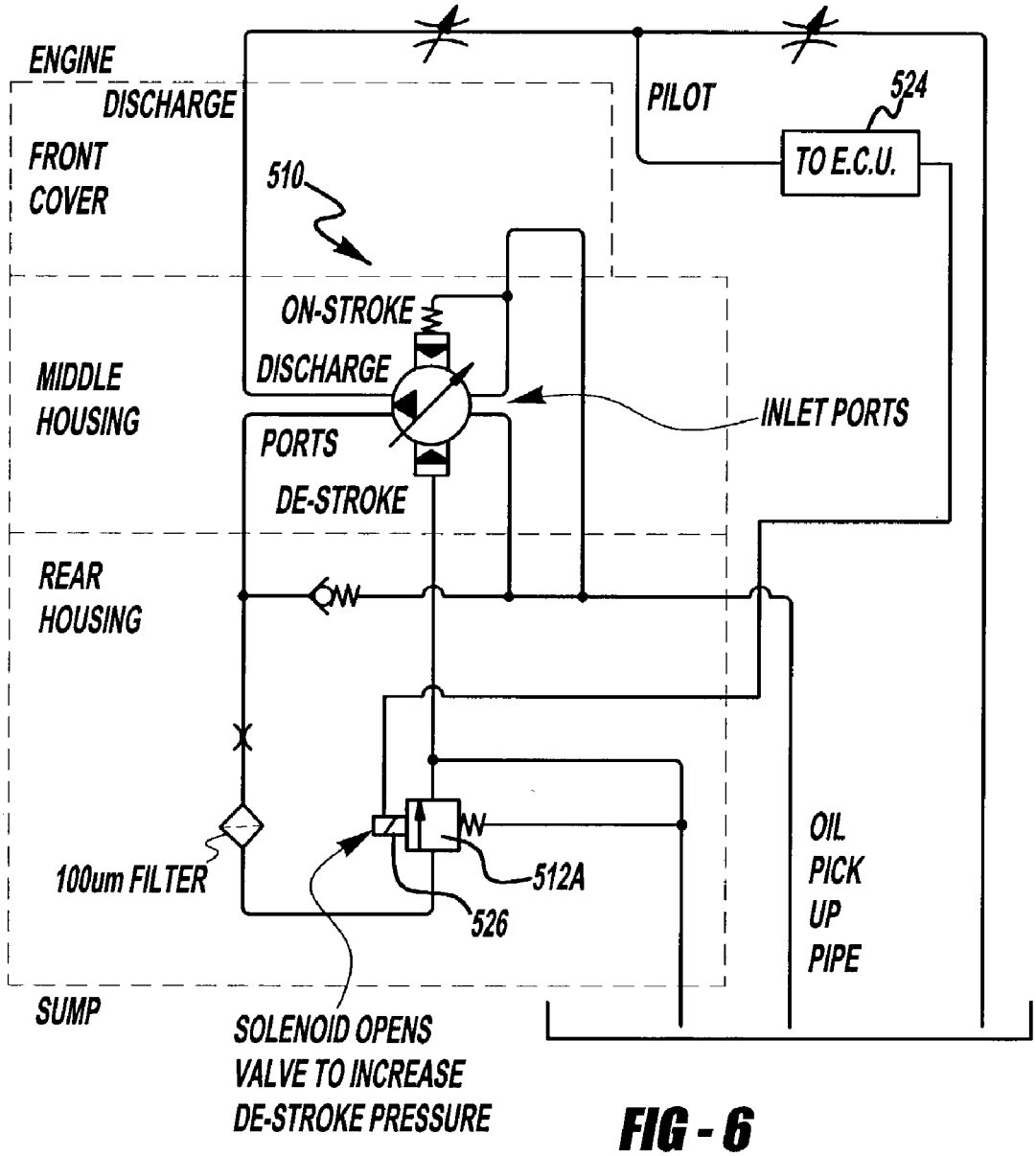
FIG. 6 is a hydraulic schematic showing a sixth embodiment of the present invention.

With respect to FIG. 6, like items referenced in FIG. 5 are similarly designated with reference numerals differing by 100. With respect to FIG. 6, a very simple control mechanism is used by the control solenoid 526 moving a valve 512A for controlling the de-stroke actuator of the pump 510. The solenoid 526 adjusts the pressure acting on the large piston which pushes against the discharge pressure acting on the small piston on the opposite side. An on-stroke return spring is provided for balancing the eccentric control ring against control inputs which can also work alone (as shown). In this embodiment, the engine control unit 524 samples the pilot pressure from a pressure transducer in the engine circuit in order to make the proper calculations as to the best valve 512A position.

Figure 7:
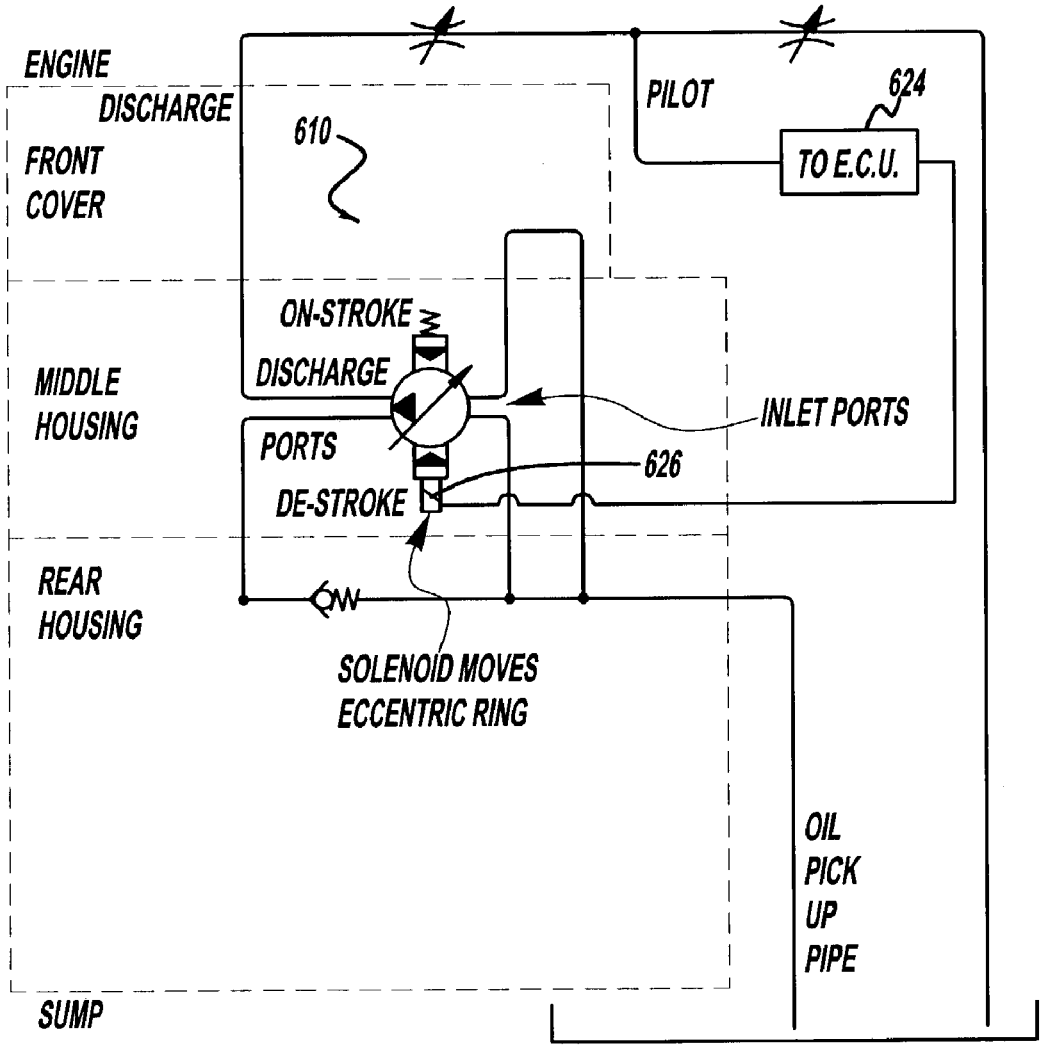
FIG. 7 is a hydraulic schematic showing a seventh embodiment of the present invention.

With respect to FIG. 7, like items referenced in FIG. 6 are similarly designated with reference numerals differing by 100. FIG. 7 is another embodiment wherein engine control unit 624 directly controls a solenoid 626 which acts directly on either the actuating piston for the eccentric ring or directly on the eccentric ring. This allows direct control of the displacement of the pump 610 based on ECU 624 monitoring of the pilot pressure of the oil pressure circuit.

Figure 8:
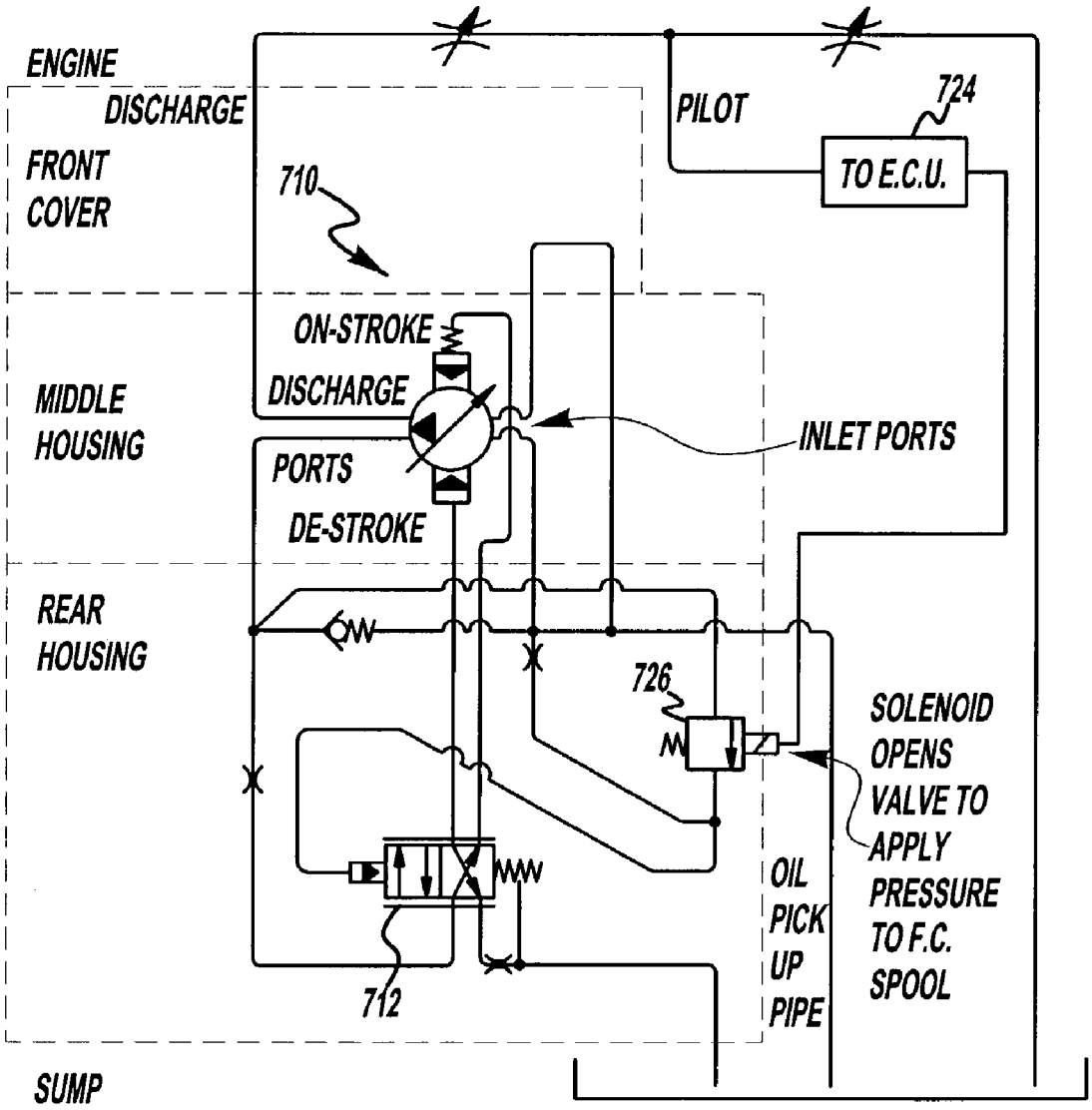
FIG. 8 is a hydraulic schematic showing an eighth embodiment of the present invention.

FIG. 8 illustrates a further embodiment wherein the solenoid 726 directly actuates the spool flow control valve 712. Again, the ECU 724 is monitoring the engine oil circuit pressure and adjusting the solenoid in accordance with the necessary engine oil pressure, as calculated by the ECU. In this embodiment, pressure from the discharge is reduced by the solenoid valve and used to bias the position of the flow control spool valve 712 against the spring for varying the displacement of the pump. Flow across the solenoid can be directed to the inlet port, as shown of the vane pump 710, but can also be drained to the sump.

As can be seen by the drawings, the methods shown in FIGS. 1 through 4 are passive systems which allow the ECU to monitor engine conditions and provide a pressure target to the pump system, but the pump system is self-regulated to the pressure target by mechanical and hydraulic controls. FIGS. 5 through 8 provide active control of the oil pressure by the ECU. In these embodiments, the ECU monitors the oil pressure and actively adjusts the system on a real time basis to control oil pressure in the engine.

Those skilled in the art can now appreciate from the foregoing description that the broad teachings of the present invention can be implemented in a variety of forms. Therefore, while this invention has been described in connection with particular examples thereof, the true scope of the invention should not be so limited, since other modifications will become apparent to the skilled practitioner upon a study of the drawings, specification and following claims.

The description of the invention is merely exemplary in nature and, thus, variations that do not depart from the scope of the invention are intended to be within the scope of the invention. Such variations are not to be regarded as a departure from the spirit and scope of the invention.

What is claimed is:

1. A pump system for delivering a controlled oil flow and oil pressure to a circuit in an engine, comprising:

a variable displacement pump;

a discharge line providing direct hydraulic communication between said pump and said engine; and a control system, including:

an actuating member capable of selectively controlling the displacement of said pump;

a variably actuatable solenoid operably associated with said actuating member; and an electronic control unit operably associated with said engine, wherein the electronic control unit is connected to and provides a variable input control signal to said solenoid;

wherein said discharge line is in hydraulic communication with said control system so as to provide hydraulic power to said control system from said pump.

2. The control system of claim 1 wherein the actuating member is hydraulically actuated and said solenoid is used to control oil flow and oil pressure from said pump.

3. The control system of claim 1 wherein the solenoid directly engages the actuating member for controlling the displacement of said pump.

4. The control system of claim 3 wherein said electronic control unit monitors engine conditions and parameters and varies the amount of current to said solenoid in response to said conditions and said parameters.

5. The control system of claim 2 further comprising a flow control spool valve which is controlled by said solenoid to control actuation flow to said actuating member.

6. The control system of claim 5 wherein said electronic control unit monitors engine conditions and parameters and varies the amount of current to said solenoid in response to said conditions and said parameters.

7. The control system of claim 5 wherein said flow control spool valve is connected to on-stroke and de-stroke actuators on said pump, wherein oil from said flow control spool valve is inputted to one of either said on-stroke and said de-stroke actuators for setting displacement of said pump during operation.

8. The control system of claim 5 wherein said flow control valve is a spool valve and said solenoid is directly connected to said spool valve.

9. The control system of claim 8 wherein said electronic control unit is connected to and monitors the pressure in a pilot line that is connected to an engine oil pressure circuit, wherein said electronic control unit generates input signals to said solenoid in response to pressure conditions in said pilot line for controlling displacement of said pump.

10. The control system of claim 9 wherein the ECU monitors the oil pressure and actively adjusts the system on a real time basis to control oil pressure in said engine oil pressure circuit.

11. The control system of claim 8 further comprising a variable target piston and a piston spring connected to said spool valve, wherein said valve member adjusts the position of said variable target piston and piston spring to set the target pressure discharged from said pump.

12. The control system of claim 5 further comprising:

a valve member functionally connected between said solenoid and said spool valve, wherein said spool valve controls the amount of hydraulic pressure inputted to said actuating member in response to the movement of said solenoid.

13. The control system of claim 12 wherein said solenoid is directly connected to said valve member and controls the opening and closing of said valve member.

14. The control system of claim 13 wherein said electronic control unit is connected to and monitors the pressure in a pilot line that is connected to an engine oil pressure circuit, wherein said electronic control unit generates input signals to said solenoid in response to pressure conditions in said pilot line for controlling displacement of said pump.

15. The control system of claim 13 further comprising a variable target piston and a piston spring connected to said spool valve, wherein said valve member changes the pressure exerted on said variable target piston and piston spring to set the target pressure discharged from said pump.

16. The control system of claim 15 wherein said valve member is connected to a sump, so that when said solenoid closes said valve member, said input pressure to said actuating member increases.

17. The control system of claim 16 wherein said ECU monitors engine conditions and provides a current indicative of the target pressure to said valve member, and wherein said pump is self-regulated to the target pressure by mechanical and hydraulic controls.

18. The control system of claim 17 wherein said engine conditions monitored comprise engine temperature, engine speed, engine load and combinations thereof.

19. The control system of claim 18 further comprising a pressure reducing and regulating valve configured between said valve member and a discharge port from said pump, wherein said pressure reducing and regulating valve creates a fixed input pressure to said valve member.

20. The control system of claim 15 wherein said input pressure to said actuating member decreases when said solenoid closes said valve member.

21. The control system of claim 19 wherein said ECU monitors engine conditions and provides a target pressure to said variable target piston and said spool valve, wherein said pump is self-regulated to the target pressure by mechanical and hydraulic controls.

22. The control system of claim 20 wherein said engine conditions monitored comprise engine temperature, engine speed, engine load and combinations thereof.

23. The control system of claim 21 further comprising a pressure reducing and regulating valve configured between said valve member and a pilot pressure port from said pump, wherein said pressure reducing and regulating valve creates a fixed input pressure to said valve member.

24. The control system of claim 7 wherein the spool is biased in a first direction with a return spring and said solenoid biases said valve against said return spring by directly engaging said flow control valve.

25. The control system of claim 24 wherein said spool valve is hydraulically actuated and said solenoid controls a valve for moving oil from a discharge of said pump to said spool valve for controlling said spool valve.

26. A pump system for an engine having an engine control unit, comprising:

a variable displacement pump having an actuator that controls the pressure and flow of oil to a pressure lubricating circuit of said engine;

a discharge line providing direct hydraulic communication between said pump and said engine;

a pilot pressure line that has oil flow and oil pressure supplied by said engine; and a control system, including:

a flow control valve for hydraulically varying the pump displacement by facilitating movement of said actuator; and a variably actuatable solenoid controlled by said engine control unit, said solenoid being operably associated with said flow control valve for providing control of oil flow through said flow control valve;

wherein said discharge line is in hydraulic communication with said control system so as to provide hydraulic power to said control system from said pump.

27. The variable displacement pump of claim 26, wherein said engine control unit monitors engine conditions and parameters and varies the amount of current to said solenoid in response to said conditions and said parameters.

28. The variable displacement pump of claim 26 wherein said pump is a vane pump and said actuator is at least part of an eccentric ring of said vane pump, wherein said vane pump and said eccentric ring operate to control the displacement of fluid to said engine.

29. The variable displacement pump of claim 28 further comprising a pressure reducing and regulating valve located between said discharge port and said solenoid valve, wherein said pressure reducing and regulating valve functions to provide a constant pressure to said solenoid valve.

30. The variable displacement pump of claim 26 wherein said solenoid is a variable force solenoid.

31. The variable displacement pump of claim 30 further comprising a compression spring connectable at a first end to said flow control valve, wherein said compression spring maintains pressure on said flow control valve during regular operation, and provides return pressure in the absence of pilot pressure on said flow control valve.

32. The variable displacement pump of claim 31 further comprising a target piston connected to a second end of said compression spring, wherein said target piston exerts force on said compression spring.

33. The variable displacement pump of claim 32 wherein said solenoid is connected to said target piston so as to directly control the movement of said target piston, wherein said solenoid further comprises an engine control unit operably connected to said solenoid, wherein said engine control unit monitors engine conditions and parameters and varies the value of an input signal and adjusts said solenoid in response to said conditions and parameters.

34. The variable displacement pump of claim 32 wherein said solenoid is connected directly to said flow control valve and regulates the stroke and de-stroke conditions of said flow control valve, wherein said method further comprises an engine control unit operably connected to and sending a control signal to said solenoid, wherein said engine control unit is connected to and monitors the oil flow and oil pressure of said pilot line and generates said input signal in response to the pressure conditions of said pilot line.

35. The variable displacement pump of claim 32 further comprising a valve operably associated with said solenoid, wherein said valve is connectable between said discharge port of said engine and said target piston, wherein said valve controls the amount of pressure exerted on said target piston and said compression spring.

36. The variable displacement pump of claim 35 further comprising an engine control unit connected to said solenoid, wherein said engine control unit monitors engine conditions and parameters and varies the value of an input to said solenoid in response to said conditions and said parameters.

37. The variable displacement pump of claim 36 wherein said pump is a vane pump and said actuator is an eccentric ring of said vane pump, wherein said vane pump and said eccentric ring operate to control the displacement of fluid to said engine.

38. A variable displacement pump for an engine comprising:

a vane pump having an eccentric ring that controls the flow of fluid to an engine input;

a pilot pressure line that has oil flow and oil pressure supplied indicative of a controlled oil flow and oil pressure in the engine;

a flow control valve for mechanically varying the pump displacement by facilitating movement of said eccentric ring;

a compression spring connectable at a first end to said flow control valve, wherein said compression spring maintains pressure on said flow control valve during regular operation, and provides return pressure in the absence of pilot pressure on said flow control valve;

a target piston connected to the second end of said compression spring, wherein said target piston exerts force on said compression spring;

a valve connectable between a discharge port of the pump and said target piston, wherein said valve controls the amount of pressure exerted on said target piston and said compression spring;

a solenoid connected to and controlling said valve for providing pressure control of fluid flow through said valve; and an engine control unit connected to said solenoid, wherein said engine control unit monitors engine conditions and parameters and varies the amount of current to said solenoid for controlling the pressure exerted on said target piston in response to said conditions and said parameters sensed by said engine control unit.

39. A variable displacement pump for an engine having an engine control unit, comprising:

a pump having an actuator that controls the pressure and flow of oil to a pressure lubricating circuit of an engine;

a pilot pressure line that has oil flow and oil pressure supplied by the engine;

a flow control valve for hydraulically varying the pump displacement by facilitating movement of said actuator;

a solenoid controlled by said engine control unit, said solenoid being operably associated with said flow control valve for providing control of oil flow through said flow control valve, wherein said solenoid is a variable force solenoid;

a compression spring connectable at a first end to said flow control valve, wherein said compression spring maintains pressure on said fluid control valve during regular operation, and provides return pressure in the absence of pilot pressure on said fluid control valve; and a target piston connected to the second end of said compression spring, wherein said target piston exerts force on said compression spring.

* * * * *